US006764589B1

(12) United States Patent
Pütter

(10) Patent No.: US 6,764,589 B1
(45) Date of Patent: Jul. 20, 2004

(54) METHOD FOR THE ELECTROLYTIC CONVERSION OF FURAN OR FURAN DERIVATIVES

(75) Inventor: Hermann Pütter, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 20 days.

(21) Appl. No.: 10/088,075

(22) PCT Filed: Sep. 15, 2000

(86) PCT No.: PCT/EP00/09072

§ 371 (c)(1),
(2), (4) Date: Mar. 20, 2002

(87) PCT Pub. No.: WO01/21857

PCT Pub. Date: Mar. 29, 2001

(30) Foreign Application Priority Data

Sep. 20, 1999 (DE) ..... 199 44 989

(51) Int. Cl.[7] ..... C25B 3/00
(52) U.S. Cl. ..... 205/455
(58) Field of Search ..... 205/455

(56) References Cited

U.S. PATENT DOCUMENTS 4,544,450 A 10/1985 Oberrauch ..... 204/59 R
4,673,933 A * 6/1987 Bauer ..... 341/22
5,668,544 A * 9/1997 Chang et al. ..... 341/26

FOREIGN PATENT DOCUMENTS

DE 196 18 854 11/1997
DE 19625730 A1 * 1/1998

OTHER PUBLICATIONS

Ponomarev et al., Furan Compounds. XIII. Electrolytic Methoxylation of Furan Substances, Zhurnal Obshchei Khimii (no mont 1960), vol. 30, pp. 976–981. Abstract Only.*

E.A. Chernyshev et al.: "Mechanism of the electrochemical synthesis of ferrocene" Translated from Elektrokhimiya, vol. 18, No. 2, pp. 211–216 02/82.

Tameo Iwasaki et al.: "Convenient synthesis of 4,4–dimethoxy esters and ketones" J. Org. Chem, vol. 47, pp. 3799–3802 1982, no month.

Yi–Lin Chen et al.: "Electrooxidation of N–Butanol to N–Butyric acid using peroxide cathoda and anode" Journal of the Chin. I. CH. E., vol. 27, No. 5, pp. 337–345 1996, no month.

M.M. Baizer: "Organic electrochemistry" pp. 1421–1430 1991, no month.

I.S. Monakhova: "Synthesis and reactions of some methoxy derivatives of furan compounds" Chemical Abstracts, vol. 92, No. 20 May 19, 1980.

A.A. Ponomarev, et al., New Data on the Elctrolytic Methoxylation of Furan Compounds, Translated from Zhurnal Obshchei Khimii, vol. 30, No. 3, pp. 976–981, Mar. 1960. Original article submitted Apr. 3, 1959.

* cited by examiner

*Primary Examiner*—Edna Wong
(74) *Attorney, Agent, or Firm*—Oblon, Spivak, McClelland, Maier & Neustadt, P.C.

(57) ABSTRACT

The present invention relates to a process for the electrolytic transformation of at least one furan-base starting compound (A) in an electrolysis circuit. This process may be carried out in an electrolysis cell and include the electrolytically oxidizing the furan-based starting compound (A) to produce at least one alkoxylated furan compound (B) which has a C—C double bond in the five-membered heterocyclic ring, and hydrogen followed by hydrogenating the C—C double bond using hydrogen obtained at a cathode in the oxidizing step, hydrogen fed to the electrolysis circuit from outside or by electrocatalytic hydrogenation.

22 Claims, No Drawings

METHOD FOR THE ELECTROLYTIC CONVERSION OF FURAN OR FURAN DERIVATIVES

The present invention relates to a process for the electrolytic transformation of furan or one or more furan derivatives.

An objective of preparative organic electrochemistry is to utilize the processes occurring at the two electrodes in an electrochemical process in parallel. Processes in which the two electrode processes which occur in an undivided cell can be utilized for the reaction of chemical compounds are of particular interest.

An example of such a process is the oxidative dimerization of 2,6-dimethylphenol, which is coupled with the dimerization of maleic esters (M. M. Baizer, in: H. Lund, M. M. Baizer (Eds), Organic Electrochemistry, Marcel Dekker, New York, 1991, pages 1442 ff.).

A further example is the coupled synthesis of phthalide and t-butylbenzaldehyde (DE 196 18 854).

However, it is also possible to utilize the cathode process and the anode process to produce a single product or to decompose a starting material. Examples of such electrochemical processes are the production of butyric acid (Y. Chen, T. Chou, J. Chin. Inst. Chem. Eng. 27 (1996) pages 337–345), the anodic dissolution of iron, which is coupled with the cathodic formation of ferrocene (T. Iwasaki et al., J. Org. Chem. 47 (1982) pages 3799 ff.) or the decomposition of phenol (A. P. Tomilov et al., Elektrokhimiya 10 (1982) page 239).

An example of a process in which a furan derivative is reacted in an undivided electrolysis cell and the two electrode processes are utilized is the oxidation of furancarboxylic acid with subsequent ring opening to form 1-carboxymethyl-4,4-dimethoxypropene which is hydrogenated in a further step to give the saturated propane derivative (T. Iwasaki et al., J. Org. Chem. 47 (1982) pages 3799 ff.). However, this is not a catalytic hydrogenation, but a direct electroreduction. In this case, however, it is not the furan which is reacted but the α,β-unsaturated ester, i.e. a class of substances whose electrochemical reduction is known. Furthermore, the ring opening and the subsequent hydrogenation do not occur directly on the anodically generated product but on a fragment which has undergone further oxidation and has one less carbon atom.

An electrochemical oxidation of furan or a furan derivative with retention of the heterocyclic ring structure and subsequent hydrogenation involving hydrogenation of a double bond which is present in the ring structure after oxidation is, however, not known in processes in which both electrode processes are utilized.

It is an object of the present invention to provide an electrochemical process which preferably proceeds in an undivided electrolysis cell and in which furan or a substituted furan is oxidized in one electrode process with retention of the heterocyclic ring structure and this oxidation product is hydrogenated by means of hydrogen which is formed as product in the other electrode process or is transferred as hydrogen equivalent to the furan derivative in the sense of an electrocatalysis.

We have found that this object is achieved by a process for the electrolytic transformation of at least one furan derivative (A) in an electrolysis circuit which comprises both the steps (i) and (ii):

(i) electrolytic oxidation of furan or a substituted furan or a mixture of two or more thereof to give (a) at least one furan derivative (B) which has a C—C double bond in the five-membered heterocyclic ring, and (b) hydrogen;

(ii) hydrogenation of this C—C double bond using the hydrogen obtained in parallel at the cathode in step (i) or hydrogen fed to the electrolysis circuit from outside or electrocatalytic hydrogenation, wherein the process is carried out in an electrolysis cell in which at least one hydrogenation catalyst is present.

The process preferably occurs in an undivided electrolysis cell.

Apart from furan, the following compounds may be mentioned as examples of preferred substituted furans: fural(furan-2-aldehyde), alkyl-substituted furans, furans substituted by —CHO, —COOH, —COOR, where R is an alkyl, benzyl or aryl group, in particular a $C_1$–$C_4$-alkyl group, —$CH(OR_1)(OR_2)$, where $R_1$ and $R_2$ may be identical or different and are each an alkyl, benzyl or aryl group, in particular a $C_1$∴$C_4$-alkyl group, and —CN groups in the 2, 3, 4 or 5 position.

In the reaction according to the present invention of organic compounds, it is possible to use solvents and electrolyte salts as are described in H. Lund, M. M. Baizer, (Eds) "Organic Electrochemistry", 3rd Edition, Marcel Dekker, New York 1991.

The oxidation is, according to the present invention, preferably carried out in the presence of methanol or in the presence of ethanol or a mixture thereof, but preferably in the presence of methanol. The substrates can simultaneously act as reactant and solvent.

Solvents which can be used in the reaction include not only furan and substituted furan and the compound used for the oxidation but also all suitable alcohols in general.

Electrolyte salts which can be used in the process of the present invention include NaBr and also, for example, alkali metal and/or alkaline earth metal halides, with bromides, chlorides and iodides being possible as halides. Ammonium halides can likewise be used.

Pressures and temperatures can assume values as are customarily employed in catalytic hydrogenations.

In a preferred embodiment of the process of the present invention, the reaction temperature T is <50° C., preferably <25° C., the pressure p is <3 bar and the pH is in the neutral region.

In a preferred embodiment of the process of the present invention, intermediates are fed in in addition to the starting materials which are introduced into the undivided electrolysis cell. The term intermediate refers to a product which is obtained as furan derivative (B) in step (i) of the above-described process by electrolytic oxidation of furan or a substituted furan or a mixture of two or more thereof and is therefore present in the electrolysis circuit. The concentration of the additional intermediates is set by means of customary electrochemical and electro-catalytic parameters, for example current density, type of catalyst and amount of catalyst or the intermediate is added to the circuit As regards the specific choice of the electrode material, there is no restriction in the process of the present invention as long as the electrodes are suitable for the above-described process.

Preference is given to using graphite anodes in the undivided cell.

As far as the geometry of the electrodes in the undivided electrolysis cell is concerned, there are essentially no restrictions in the process of the present invention. Preferred geometries are, for example, flat parallel electrode arrangements and annular or cylindrical electrode arrangements.

In a preferred embodiment of the invention, at least one electrode is in contact with at least one hydrogenation catalyst. In a particularly preferred embodiment, the at least one hydrogenation catalyst is part of a gas diffusion electrode. In a further preferred embodiment of the invention, at least one electrode is a graphite electrode which is coated with noble metal and is in the form of a plate, mesh or felt. In another preferred embodiment of the invention, the hydrogenation catalyst in the form of a suspension in the electrolyte is continually brought into contact with at least one electrode. Here, the hydrogenation catalyst, i.e. the catalytically active material, is pumped around in the cell or washed onto an appropriately structured cathode or anode. Such a wash-coated electrode is described, for example, in DE 196 20 861.

If a gas diffusion electrode is used for at least one of the electrodes, the material from which the gas diffusion electrode is made can in principle have been processed so that the gas diffusion electrode can be used as electrode without support material. In a preferred embodiment, an alternative is provided by at least one of the electrodes used being a composite which comprises at least one conventional electrode material and at least one material for a gas diffusion electrode.

It is conceivable for this further electrode material to comprise one electric conductor or a plurality of electric conductors.

It is in principle conceivable for the composite comprising the conventional electrode material and the material of the gas diffusion electrode to be used as one electrode in the process of the present invention together with one or more suitable counterelectrodes.

These one or more suitable counterelectrodes are subject to no restrictions in respect of their geometry and their chemical composition, as long as the process of the present invention can be carried out using them.

In a preferred embodiment of the process of the present invention, the further electrode material which forms a composite with the gas diffusion electrode material is also used as counterelectrode to the gas diffusion electrode. This is achieved by a bipolar electrode arrangement.

In a preferred embodiment of the process of the present invention, graphite and/or carbon fiber paper are/is used as base material for the gas diffusion electrode. The catalyst composition is applied thereto.

As support material on which the gas diffusion electrode material is supported, preference is given, in the process of the present invention, to further electrode materials comprising carbon.

In the process of the present invention, a C—C double bond is, as described above, hydrogenated electrocatalytically using the hydrogen obtained in step (i) or using the corresponding hydrogen equivalents in the sense of an electrolysis. In this hydrogenation, the compound to be hydrogenated is preferably brought into contact with one or more hydrogenation catalysts.

As regards the choice of hydrogenation-active catalysts, there are in principle no restrictions for the purposes of the process of the present invention. All catalysts known from the prior art can be used. Mention may be made, inter alia, of the metals of transition groups I, II and VIII of the Periodic Table, in particular Co, Ni, Fe, Ru, Rh, Re, Pd, Pt, Os, Ir, Ag, Cu, Zn and Cd.

For example, it is possible to use the metals in finely divided form. Examples are Raney Ni, Raney Co, Raney Ag and Raney Fe, each of which may further comprise other elements such as Mo, Cr, Au, Mn, Hg, Sn or S, Se, Te, Ge, Ga, P, Pb, As, Bi or Sb.

It is naturally also possible for the hydrogenation-active materials described to comprise a mixture of two or more of the hydrogenation metals mentioned, which may, if desired, be combined with, for example, one or more of the above-mentioned elements.

Of course, it is also conceivable for the hydrogenation-active material to be applied to an inert support. As such support systems, it is possible to use, for example, activated carbon, graphite, carbon black, silicon carbide, aluminum oxide, silicon dioxide, titanium dioxide, zirconium dioxide, magnesium oxide, zinc oxide or mixtures of two or more thereof, e.g. as a suspension or as finely divided granulated material.

In a preferred embodiment of the present invention, the hydrogenation-active material is applied to the base material of the gas diffusion electrode.

Accordingly, the present invention also provides a process as described above in which the base material of the gas diffusion electrode is laden with a hydrogenation-active material.

As hydrogenation-active material with which the gas diffusion electrode system is laden, it is possible to use all hydrogenation catalysts as described above. Of course, it is also possible to use a mixture of two or more of these hydrogenation catalysts as hydrogenation-active material.

It is naturally also conceivable in the process of the present invention for the gas diffusion electrode material to be laden with hydrogenation-active material and for use to be made of additional hydrogenation-active material which is identical to or different from that with which the gas diffusion electrode material is laden.

The process of the present invention, as described above, in principle allows, in particular, a choice between using the electrocatalytically active electrode, i.e. the electrode which is in contact with a hydrogenation catalyst, as cathode or as anode or as cathode and anode.

The present invention therefore also provides a process as described above in which the electrocatalytically active electrode, for example a gas diffusion electrode, is used as cathode and/or as anode.

Furthermore, the present invention provides a process as described above in which the furan derivative (B) produced is reacted to form at least one ring-opened butane derivative. The ring-opened butane derivative is preferably 1,1,4,4-tetrarnethoxybutane or a substituted 1,1,4,4-tetramethoxybutane.

The following examples illustrate the present invention.

EXAMPLES

Example 1

An undivided cell having 6 annular electrodes with a surface area per side of 15.7 $cm^2$ was used. The electrodes were separated from one another by means of 5 spacer meshes having a thickness of 0.7 mm.

The uppermost and lowermost electrodes were connected to electric power. The uppermost electrode was connected as an anode, the lowermost electrode was connected as a cathode and the electrodes between them were bipolar.

The electrodes comprised graphite disks which had a thickness of 5 mm each and were coated on one side with gas diffusion electrode material. This material was in turn coated with 10 g of platinum/$m^2$.

The gas diffusion electrode was connected as cathode.

The electrolysis batch consisted of 30 g of furan, 57.63 g of 2,5-dimethoxydihydrofuran, 2 g of NaBr and 112 g of methanol.

Electrolysis was carried out at 0.47 A and 15° C. During the reaction, the cell voltage rose from 13.0 V to 17.4 V. The electrolysis was monitored by gas chromatography.

After 1 F/mol of furan, the proportion of furan in GC-percent by area had dropped from 22.9% to 18.8%, while the proportion of dimethoxydihydrofuran had increased from 32.2% to 34.5%. At the same time, 1.4% of 2,5-dimethoxytetrahydrofuran were formed.

Example 2

The cell arrangement corresponded to that of Example 1. Instead of a Pt-laden gas diffusion cathode, use was made of a gas diffusion electrode laden with 5.2 g/m$^2$ of Pd.

The electrolysis batch consisted of 60 g of furan, 126.2 g of 2,5-dimethoxydihydrofuran, 2 g of NaBr and 234.4 g of methanol.

Electrolysis was carried out at 0.47 A and about 18° C. The cell voltage rose from 19.1 V to 26.4 V. The electrolysis was monitored by gas chromatography.

After 1 F/mol of furan, the proportion of furan in GC-percent by area had dropped from 22.8% to 18.0%, while the proportion of dimethoxydihydrofuran had increased from 30.7% to 30.9%. At the same time, 0.7% of 2,5-dimethoxytetrahydrofuran were formed.

Example 3

The cell arrangement corresponded to that of Example 1. Instead of a gas diffusion cathode, use was made of a gas diffusion electrode laden with 5.2 g of Pd/m$^2$ as anode.

The electrolysis batch consisted of 30 g of furan, 57.4 g of 2,5-dimethoxydihydrofuran, 2 g of NaBr and 110.6 g of methanol.

Electrolysis was carried out at 0.48 A and about 17° C. The cell voltage rose from 16.3 V to 19.5 V. The electrolysis was monitored by gas chromatography.

After 1 F/mol of furan, the proportion of furan in GC-percent by area had dropped from 22.7% to 16.9%, while the proportion of 2,5-dimethoxydihydrofuran in GC-percent by area remained constant at 30%. At the same time, 3.3% of 2,5-dimethoxytetrahydrofuran were formed.

Example 4

A cell having 5 annular electrodes with a surface area of 44 cm$^2$ was used. The electrodes were each separated from one another by 2 spacer meshes having a thickness of 1 mm.

The electrodes comprised graphite disks which had a thickness of 5 mm each and had been coated on the sides in contact with electrolyte, both anodic and cathodic, with gas diffusion electrode material. This material was covered with 0.5 mg of Pd/cm$^2$.

The electrolysis batch consisted of 120 g of furan, 229.9 g of 2,5-dimethoxydihydrofuran, 8 g of NaBr and 542.5 g of MeOH.

The electrolysis was carried out at 1.32 A to a power usage of 2 F/mol of furan, and the electrolysis temperature was 17° C. The electrolysis was monitored by gas chromatography.

The furan concentration had decreased from 21.2% by area to 13.4% by area, and the 2,5-dimethoxydihydrofuran concentration had decreased from 25.2% by area to 23.3% by area At the same time, 3.5% by area of dimethoxytetrahydrofuran had been formed. Ring opening took place in this experiment.

1,1,4,4-tetramethoxy-cis-butene [1.3% by area] was formed from 2,5-dimethoxydihydrofuran and 4.2% by area of 1,1,4,4-tetramethoxybutane were formed from 2,5-dimethoxytetrahydrofuran.

This means that the amount of furan has decreased by one third, the stage of methoxylation (ring-closed and ring-opened) has remained virtually constant and the further hydrogenation has taken place to a great extent which corresponds to the decrease in the amount of furan.

Example 5

Reaction of Furan in the Presence of a Hydrogenation Catalyst

The reaction took place in a frame cell having three anodes and three cathodes comprising a flexible graphite board "Sigrabond CFC 07G" from SGL, Meitingen, coated on one side with a graphite mesh. One anode and one cathode were made monopolar and served as end plates while the other two electrodes were connected so as to act as two bipolar electrodes. The electrodes were kept the intended distance apart by means of conventional spacer meshes. The spacing was 5 mm. The area of each electrode was 4.8×9.5 cm.

In this cell, an electrolyte consisting of 75 g of furan, 222 g of methanol, 3 g of NaBr and 0.5 g of activated carbon containing 10% of palladium was reacted at 26° C. At a current of 1.36 A and a mean cell voltage of 24 V, electrolysis was carried out for 7.5 hours with the catalyst-containing suspension continually being pumped around the cell circuit. At the end, the furan content had dropped to 55% of the initial value. With a selectivity of about 95%, 2,5-dimethoxydihydrofuran, 2,5-dimethoxytetrahydrofuran and 1,1,4,4-tetramethoxybutane had been formed in a ratio of 1:0.75:1.55. The proportion of simultaneously methoxylated and hydrogenated products was thus 70%.

I claim:

1. A process for the electrolytic transformation of at least one furan-based starting compound (A) in an electrolysis circuit wherein the process is carried out in an electrolysis cell in which at least one hydrogenation catalyst is present, the process comprising both steps (i) and (ii):

(i) electrolytically oxidizing the at least one furan-based starting compound (A) to produce (a) at least one alkoxylated furan compound (B) which has a C—C double bond in the five-membered heterocyclic ring, and (b) hydrogen;

(ii) hydrogenating the C—C double bond in the presence of the at least one hydrogenation catalyst using hydrogen obtained at a cathode in step (i), hydrogen fed to the electrolysis circuit from outside or by electrocatalytic hydrogenation.

2. A process as claimed in claim 1, wherein the electrolysis cell is an undivided electrolysis cell.

3. A process as claimed in claim 2, wherein at least one electrode is in contact with the at least one hydrogenation catalyst.

4. A process as claimed in claim 3, wherein the at last one electrode which is in contact with the hydrogenation catalyst is used as the cathode or as an anode or as the cathode and the anode.

5. A process as claimed in claim 3, wherein the hydrogenation catalyst comprises a noble metal.

6. A process as claimed in claim 1, wherein at least one electrode is in contact with the at least one hydrogenation catalyst.

7. A process as claimed in claim 6, further comprising applying the hydrogenation catalyst to a graphite felt.

8. A process as claimed in claim 7, wherein the at least one electrode which is in contact with the hydrogenation catalyst is used as the cathode or as an anode or as the cathode and the anode.

9. A process as claimed in claim 6, further comprising washing the hydrogenation catalyst onto the at least one electrode.

10. A process as claimed in claim 9, wherein the at least one electrode which is in contact with the hydrogenation catalyst is used as the cathode or as an anode or as the cathode and the anode.

11. A process as claimed in claim 6, wherein the hydrogenation catalyst is in the form of a suspension.

12. A process as claimed in claim 11, wherein the at least one electrode which is in contact with the hydrogenation catalyst is used as the cathode or as an anode or as the cathode and the anode.

13. A process as claimed in claim 6, wherein the at least one electrode which is in contact with the hydrogenation catalyst is used as the cathode or as an anode or as the cathode and the anode.

14. A process as claimed in claim 6, wherein the hydrogenation catalyst comprises a noble gas metal.

15. A process as claimed in claim 1, wherein at least one of the electrodes used is a gas diffusion electrode.

16. A process as claimed in claim 15, wherein the at least one electrode is in contact with a hydrogenation catalyst and is used as the cathode or as an anode or as the cathode and the anode.

17. A process as claimed in claim 1, wherein at least one of the electrodes used is a composite comprising at least one conventional electrode material and at least one material for a gas diffusion electrode.

18. A process as claimed in claim 17, wherein the conventional electrode material comprises carbon.

19. A process as claimed in claim 18, wherein at least one electrode is in contact with a hydrogenation catalyst and is used as the cathode or as an another or as the cathode and the anode.

20. A process as claimed in claim 17, wherein the at least one electrode is in contact with a hydrogenation catalyst and is used as the cathode or as an anode or as the cathode and the anode.

21. A process as claimed in claim 1, wherein the at least one alkoxylated furan compound (B) produced in step (i) is reacted in step (ii) to form at least one ring-opened butane derivative.

22. A process as claimed in claim 21, wherein the ring-opened butane derivative is 1,1,4,4-tetramethoxybutane or a substituted 1,1,4,4-tetramethoxybutane.

* * * * *